US006605000B2

(12) United States Patent
Adams

(10) Patent No.: US 6,605,000 B2
(45) **Date of Patent: *Aug. 12, 2003**

(54) SLOT MACHINE WITH ADDITIONAL PAYOUT INDICATOR

(75) Inventor: William R. Adams, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/157,608

(22) Filed: May 29, 2002

(65) Prior Publication Data

US 2002/0142826 A1 Oct. 3, 2002

Related U.S. Application Data

(63) Continuation of application No. 09/444,986, filed on Nov. 22, 1999, now abandoned, which is a continuation of application No. 09/169,668, filed on Oct. 9, 1998, now abandoned, which is a continuation of application No. 08/622,430, filed on Mar. 29, 1996, now Pat. No. 5,823,874, which is a continuation-in-part of application No. 08/311,783, filed on Sep. 23, 1994, now abandoned.

(51) Int. Cl.[7] ..... A63F 9/24
(52) U.S. Cl. ..... 463/20
(58) Field of Search ..... 463/16–22, 25–28; 273/143 R, 138 A

(56) References Cited

U.S. PATENT DOCUMENTS

| | | | | |
|---|---|---|---|---|
| 3,281,149 | A | 10/1966 | Miller | 273/143 |
| 4,036,500 | A | 7/1977 | Kiernan | 273/130 |
| 4,149,728 | A | 4/1979 | Thompson | 273/274 |
| 4,448,419 | A | 5/1984 | Telnaes | 273/143 R |
| 4,492,378 | A | 1/1985 | Williams | 273/142 |
| 4,624,459 | A | 11/1986 | Kaufman | 273/143 R |
| 4,700,948 | A | 10/1987 | Okada | 273/143 R |
| 4,711,451 | A | 12/1987 | Pajak et al. | 273/143 R |
| 4,805,907 | A | 2/1989 | Hagiwara | 273/138 A |
| 4,871,171 | A | 10/1989 | Rivero | 273/138 A |
| 4,906,005 | A | 3/1990 | Manabe | 273/142 R |
| 4,964,638 | A | 10/1990 | Ishida | 273/138 A |
| 4,991,848 | A | 2/1991 | Greenwood et al. | 273/143 R |
| 4,998,199 | A | 3/1991 | Tashiro et al. | 364/410 |
| 5,042,810 | A | 8/1991 | Williams | 273/142 |
| 5,067,712 | A | 11/1991 | Georgilas | 273/143 R |
| 5,078,405 | A | 1/1992 | Jones et al. | 273/309 |
| 5,102,134 | A | 4/1992 | Smyth | 273/138 A |
| 5,152,529 | A | 10/1992 | Okada | 273/143 R |

(List continued on next page.)

FOREIGN PATENT DOCUMENTS

| | | |
|---|---|---|
| AU | 39332/78 | 3/1980 |
| AU | 75789/81 | 9/1981 |

(List continued on next page.)

OTHER PUBLICATIONS

One–page document entitled "U.S. Additional Payout Indicator Family".

U.S. patent application Ser. No. 08/311,783 as filed in the Patent Office on Sep. 23, 1994, inventor William Adams, 13 pages of text, 1 drawing sheet.

(List continued on next page.)

*Primary Examiner*—Michael O'Neill
(74) *Attorney, Agent, or Firm*—Marshall, Gerstein & Borun

(57) ABSTRACT

Gaming devices comprising a standard gaming unit, e g., three reels, and a discernible additional payout indicator, e.g., a rotatable wheel. A preferred bonus payout indicator is clearly visible by the player and is actuatable when the reels of the slot machine stop on certain predetermined indicia. A preferred embodiment further comprises a payout multiplier which displays a plurality of values by which a payout may be multiplied.

19 Claims, 3 Drawing Sheets

U.S. PATENT DOCUMENTS

| | | | | |
|---|---|---|---|---|
| 5,167,413 | A | 12/1992 | Fulton | 273/85 CP |
| 5,184,821 | A | 2/1993 | Korenek | 273/138 A |
| 5,188,363 | A | 2/1993 | Marnell, II et al. | 273/85 CP |
| 5,205,555 | A | 4/1993 | Hamano | 273/143 R |
| 5,209,479 | A | 5/1993 | Nagao et al. | 273/143 R |
| 5,259,616 | A | 11/1993 | Bergmann | 273/138 A |
| 5,265,874 | A | 11/1993 | Dickinson et al. | 273/138 A |
| 5,292,127 | A | 3/1994 | Kelly et al. | 273/138 R |
| 5,332,219 | A | 7/1994 | Marnell, II et al. | 273/138 A |
| 5,342,049 | A | 8/1994 | Wichinsky et al. | 273/119 R |
| 5,344,144 | A | 9/1994 | Canon | 273/138 A |
| 5,344,145 | A | 9/1994 | Chadwick et al. | 273/138 A |
| 5,362,052 | A | 11/1994 | Kubatsch | 273/145 R |
| 5,377,973 | A | 1/1995 | Jones et al. | 463/12 |
| 5,393,061 | A | 2/1995 | Manship et al. | 273/143 R |
| 5,409,225 | A | 4/1995 | Kelly et al. | 273/138 R |
| 5,411,271 | A | 5/1995 | Mirando | 273/434 |
| 5,486,005 | A | 1/1996 | Neal | 273/292 |
| 5,513,846 | A | 5/1996 | Niederlein et al. | 273/143 R |
| 5,540,442 | A | 7/1996 | Orselli et al. | 463/17 |
| 5,560,603 | A | 10/1996 | Seelig et al. | 463/6 |
| 5,570,885 | A | 11/1996 | Ornstein | 463/27 |
| 5,580,309 | A | 12/1996 | Piechowiak et al. | 463/16 |
| 5,628,684 | A | 5/1997 | Bouedec | 463/17 |
| 5,655,961 | A | 8/1997 | Acres et al. | 463/27 |
| 5,664,998 | A | 9/1997 | Seelig et al. | 463/20 |
| 5,697,843 | A | 12/1997 | Manship et al. | 463/20 |
| 5,702,304 | A | 12/1997 | Acres et al. | 463/29 |
| 5,704,835 | A | 1/1998 | Dietz, II | 463/20 |
| 5,722,891 | A | 3/1998 | Inoue | 463/20 |
| 5,725,428 | A | 3/1998 | Achmuller | 463/20 |
| 5,741,183 | A | 4/1998 | Acres et al. | 463/42 |
| 5,743,523 | A | 4/1998 | Kelly et al. | 273/138 |
| 5,752,882 | A | 5/1998 | Acres et al. | 463/42 |
| 5,772,509 | A | 6/1998 | Weiss | 463/16 |
| 5,788,573 | A | 8/1998 | Baerlocher et al. | 463/16 |
| 5,806,045 | A | 9/1998 | Biorge et al. | 705/14 |
| 5,820,459 | A | 10/1998 | Acres et al. | 463/25 |
| 5,820,460 | A | 10/1998 | Fulton | 463/13 |
| 5,823,874 | A | 10/1998 | Adams | 463/17 |
| 5,836,817 | A | 11/1998 | Acres et al. | 463/26 |
| 5,848,932 | A | 12/1998 | Adams | 463/20 |
| 5,947,820 | A | 9/1999 | Morro et al. | 463/9 |
| 6,048,268 | A | 4/2000 | Humble | 463/17 |
| 6,089,978 | A | 7/2000 | Adams | 463/20 |
| 6,334,814 | B1 | 1/2002 | Adams | 463/20 |

FOREIGN PATENT DOCUMENTS

| | | | |
|---|---|---|---|
| AU | 79361/91 | | 6/1991 |
| AU | 80248/91 | | 7/1991 |
| AU | 18428/92 | | 6/1992 |
| AU | 21070/92 | | 8/1992 |
| AU | 52186/93 | | 12/1993 |
| DE | 29 11 643 | C2 | 2/1982 |
| DE | 30 35 898 | A1 | 4/1982 |
| DE | 30 35 947 | A1 | 5/1982 |
| DE | 29 38 307 | C2 | 6/1982 |
| DE | 31 39 585 | A1 | 4/1983 |
| DE | 31 39 587 | A1 | 4/1983 |
| DE | 32 07 868 | A1 | 9/1983 |
| DE | 32 13 400 | A1 | 10/1983 |
| DE | 33 34 474 | A1 | 4/1984 |
| DE | 34 15 114 | A1 | 10/1985 |
| DE | 34 39 635 | A1 | 4/1986 |
| DE | 34 39 636 | A1 | 4/1986 |
| DE | 34 38 573 | A1 | 5/1986 |
| DE | 34 44 148 | A1 | 6/1986 |
| DE | 29 38 307 | C3 | 7/1987 |
| DE | 36 01 631 | A1 | 7/1987 |
| DE | 37 03 548 | A1 | 3/1988 |
| DE | 36 38 099 | A1 | 5/1988 |
| DE | 37 00 861 | A1 | 7/1988 |
| DE | 37 01 622 | A1 | 8/1988 |
| DE | 30 44 243 | C2 | 3/1989 |
| DE | 38 22 636 | A1 | 1/1990 |
| DE | 38 25 183 | A1 | 2/1990 |
| DE | 38 30 648 | A1 | 3/1990 |
| DE | 38 31 740 | A1 | 3/1990 |
| DE | 39 15 655 | A1 | 11/1990 |
| DE | 28 28 796 | C3 | 3/1991 |
| DE | 40 14 477 | A1 | 7/1991 |
| DE | 40 36 728 | A1 | 5/1992 |
| DE | 33 47 508 | C2 | 3/1993 |
| DE | 41 28 633 | A1 | 3/1993 |
| DE | 37 26 495 | C2 | 4/1993 |
| DE | 41 33 273 | A1 | 4/1993 |
| DE | 34 36 783 | C2 | 7/1993 |
| DE | 41 43 128 | A1 | 7/1993 |
| DE | 42 01 534 | A1 | 7/1993 |
| DE | 42 11 438 | A1 | 10/1993 |
| DE | 42 11 440 | A1 | 10/1993 |
| DE | 42 11 443 | A1 | 10/1993 |
| DE | 43 31 257 | A1 | 11/1993 |
| DE | 42 20 132 | A1 | 12/1993 |
| DE | 42 26 091 | A1 | 2/1994 |
| DE | 42 26 874 | A1 | 2/1994 |
| DE | 42 31 086 | A1 | 3/1994 |
| DE | 42 32 762 | A1 | 3/1994 |
| DE | 42 38 896 | A1 | 5/1994 |
| DE | 43 01 855 | A1 | 7/1994 |
| DE | 37 00 861 | C2 | 4/1995 |
| DE | 43 34 613 | A1 | 4/1995 |
| DE | 43 36 916 | A1 | 5/1995 |
| DE | 43 43 346 | A1 | 6/1995 |
| DE | 43 43 361 | A1 | 6/1995 |
| DE | 44 05 879 | A1 | 8/1995 |
| DE | 44 25 731 | A1 | 1/1996 |
| DE | 44 26 658 | A1 | 1/1996 |
| DE | 44 32 898 | A1 | 3/1996 |
| EP | 0 219 305 | A2 | 10/1986 |
| EP | 0 281 402 | A2 | 3/1988 |
| EP | 0 333 338 | A2 | 2/1989 |
| ES | 529535 | | 6/1983 |
| ES | 529536 | | 6/1983 |
| ES | 2006400 | | 4/1989 |
| ES | 2006401 | | 4/1989 |
| ES | 2018982 | | 12/1989 |
| ES | 2011880 | | 2/1990 |
| ES | 2013885 | | 6/1990 |
| ES | 2016168 | | 10/1990 |
| ES | 2047436 | | 2/1994 |
| ES | 2047437 | | 2/1994 |
| ES | 2072187 | | 7/1995 |
| ES | 2072188 | | 7/1995 |
| FR | 1 474 617 | | 2/1967 |
| GB | 1242298 | | 8/1971 |
| GB | 1428157 | | 3/1976 |
| GB | 1444085 | | 7/1976 |
| GB | 1476848 | | 6/1977 |
| GB | 2066991 | | 7/1981 |
| GB | 2072395 | | 9/1981 |
| GB | 2083936 | | 3/1982 |
| GB | 2084371 | | 4/1982 |
| GB | 2086632 | | 5/1982 |
| GB | 2096376 | | 10/1982 |
| GB | 2098779 | | 11/1982 |
| GB | 2101380 | | 1/1983 |
| GB | 2105891 | | 3/1983 |
| GB | 2106685 | | 4/1983 |
| GB | 2133994 | | 8/1984 |

| | | |
|---|---|---|
| GB | 2137392 | 10/1984 |
| GB | 2152262 | 7/1985 |
| GB | 2153572 | 8/1985 |
| GB | 2169737 | 7/1986 |
| GB | 2170636 | 8/1986 |
| GB | 2170937 | 8/1986 |
| GB | 2170938 | 8/1986 |
| GB | 2180682 | 4/1987 |
| GB | 2181589 | 4/1987 |
| GB | 2182186 | 5/1987 |
| GB | 2191030 | 12/1987 |
| GB | 2197974 | 6/1988 |
| GB | 2201821 | 9/1988 |
| GB | 2202984 | 10/1988 |
| GB | 2216322 | 4/1989 |
| GB | 2210191 | 6/1989 |
| GB | 2218558 | 11/1989 |
| GB | 2222712 | 3/1990 |
| GB | 2230373 | 10/1990 |
| GB | 2242300 | 9/1991 |
| GB | 2262642 | 6/1993 |
| GB | 2273384 | 6/1994 |
| GB | 2292245 | 2/1996 |
| JP | 4-58966 | 2/1992 |
| JP | 5-131044 | 5/1993 |
| JP | 5-131045 | 5/1993 |
| JP | 5-131046 | 5/1993 |
| JP | 6-190114 | 7/1994 |
| JP | 6-254208 | 9/1994 |
| JP | 6-327806 | 11/1994 |
| WO | 91/17529 | 11/1991 |

OTHER PUBLICATIONS

U.S. patent application Ser. No. 08/622,430 as filed in the Patent Office on Mar. 29, 1996, inventor William Adams, 27 pages of text, 3 drawing sheets.
U.S. patent application Ser. No. 09/157,995 as filed in the Patent Office on Sep. 22, 1998, inventor William Adams, 29 pages of text, 6 drawing sheets.
Appeal Brief dated Nov. 28, 2001 and Appendix showing claims on appeal as filed in U.S. patent application Ser. No. 09/157,995.
U.S. patent application Ser. No. 09/157,997 as filed in the Patent Office on Sep. 22, 1998, inventor William Adams, 29 pages of text, 6 drawing sheets.
U.S. patent application Ser. No. 09/966,333 as filed in the Patent Office on Sep. 27, 2001, inventor William Adams, 38 pages of text, 17 drawing sheets.
Coin Slot, Jan. 13, 1979, p. 21, Anchor 15731.
Coin Slot, Jan. 27, 1979, p. 32, Anchor 15729.
Coin Slot, Oct. 27, 1979, p. 5, Anchor 15730.
Coin Slot, Jun. 22, 1984, p. 11, Anchor 15718.
Coin Slot, Jan. 25, 1985, p. 20, Anchor 15720.
Coin Slot, Oct. 18, 1985, p. 12, Anchor 15722.
Coin Slot, Jan. 24, 1986, p. 14, Anchor 15723.
Coin Slot, Jan. 24, 1986, p. 40, Anchor 15726.
Coin Slot, Feb. 14, 1986, p. 28, Anchor 15725.
Coin Slot, May 8, 1987, p. 40, Anchor 15732.
Coin Slot, May 8, 1987, p. 41, Anchor 15727.
Coin Slot, Nov. 4, 1988, p. 6, Anchor 15728.
Coin Slot, Feb. 14, 1992, p. 21, Acres 013947.
Coin Slot, Feb. 14, 1992, various pages, Acres 013948–013950.
Coin Slot, Apr. 10, 1992, various pages, Acres 013951–013954.
Coin Slot, May 8, 1992, various pages, Acres 013943–013944.
Coin Slot, May 22, 1992, various pages, Acres 013939–013940 and 103946.
Coin Slot, May 29, 1992, various pages, Acres 013935–013938.
Coin Slot, Jul. 17, 1992, various pages, Acres 013941–013942.
Coin Slot, Oct. 16, 1992, p. 23, Acres 013955.
Coin Slot, date unknown, Anchor 15721.
EuroSlot, Mar. 1992, front page, contents page, p. 48, Acres 013910–013912.
EuroSlot, May 1992, front page, contents page, p. 43, Acres 013913–013915.
EuroSlot, Jun. 1992, front page, contents page, add'l pages, Acres 013916–013919.
EuroSlot, Sep. 1992, front page, contents page, add'l page, Acres 013920–013922.
EuroSlot, Oct. 1992, front page, contents page, add'l page, Acres 013923–013925.
EuroSlot, Jan. 1993, front page, contents page, add'l pages, Acres 013926–013929.
EuroSlot, Feb. 1993, front page, contents page, add'l page, Acres 013930–013932.
EuroSlot, Nov. 1993, front page, contents page, add'l pages, Acres 013887–013890.
EuroSlot, Feb. 1994, front page, contents page, add'l page, Acres 013891–013893.
EuroSlot, Mar. 1994, front page, contents page, add'l pages, Acres 013894–013897.
EuroSlot, Apr. 1994, front page, contents page, add'l page, Acres 013898–013900.
EuroSlot, Jun. 1994, front page, contents page, add'l page, Acres 013901–013903.
EuroSlot, Aug. 1994, front page, contents page, add'l page, Acres 013904–013906.
EuroSlot, Sep. 1994, front page, contents page, add'l page, Acres 013907–013909.
Spanish Official Bulletin of Industrial Property, Aug. 1, 1981, pp. 4995–4996, Anchor 18080.
Spanish Official Bulletin of Industrial Property, Mar., 1982, p. 1319, Anchor 18059.
Spanish Official Bulletin of Industrial Property, 1982, p. 114, Anchor 18058.
Spanish Official Bulletin of Industrial Property, Jan. 16, 1984, p. 115, Anchor 18057.
Spanish Official Bulletin of Industrial Property, 1985, p. 1786, Anchor 18056.
Spanish Official Bulletin of Industrial Property, 1985, p. 1370, Anchor 18090.
Spanish Official Bulletin of Industrial Property, 1986, p. 6610, Anchor 18077, with English translation of abstract 293.376.
Spanish Official Bulletin of Industrial Property, 1986, p. 1490, Anchor 18072.
Spanish Official Bulletin of Industrial Property, 1986, p. 1484, Anchor 18079.
Spanish Official Bulletin of Industrial Property, Dec. 16, 1986, p. 7571, Anchor 18078.
Spanish Official Bulletin of Industrial Property, Apr. 1, 1988, pp. 1491–1492, Anchor 18070–18071, with English translation of abstracts 1000994 and 1000995.
Spanish Official Bulletin of Industrial Property, May 1, 1988, p. 1977, Anchor 18069, with English translation of abstract 1001364.

Spanish Official Bulletin of Industrial Property, Oct. 16, 1988, pp. 5471–5472, Anchor 18067–18068.
Spanish Official Bulletin of Industrial Property, Jan. 16, 1989, pp. 595–596, Anchor 18065–18066.
Spanish Official Bulletin of Industrial Property, Feb. 1, 1989, pp. 893–894, Anchor 18063–18064.
Spanish Official Bulletin of Industrial Property, Mar. 1, 1989, pp. 1555–1556, Anchor 18061–18062, with English translation of abstract 1007715.
Spanish Official Bulletin of Industrial Property, Apr. 16, 1989, p. 2608, Anchor 18060.
Spanish Official Bulletin of Industrial Property, Apr. 16, 1989, pp. 2610–2611, Anchor 18088–18089, with English translations of abstracts 1008483, 1008484.
Spanish Official Bulletin of Industrial Property, Oct. 1, 1989, p. 5249, Anchor 18087.
Spanish Official Bulletin of Industrial Property, Jan. 1, 1992, p. 88, Anchor 18086.
Spanish Official Bulletin of Industrial Property, Feb. 16, 1994, p. 1089, Anchor 18085, with English translation of abstract 1025847.
Document describing "Wheel of Fortune" and "Wheel Deal" games, document refers to dates of Oct. 1981 and Jan. 1982, Anchor 15537.
Document showing "Wheel of Fortune" and "Wheel n' Deal" games, undated, Anchor 15538.
Document describing "Number One" game, document refers to date of Nov. 1984, Anchor 15539.
Document showing "Number 1" game, undated, Anchor 15540.
Document describing "Silver Gambler" game, document refers to date of Jul. 1977, Anchor 15542.
Document showing "Silver Gambler" game, undated, Anchor 15543.
Document describing, "Cash Drop" game, document refers to date of Dec. 1979, Anchor 15544.
Document showing "Cash Drop" game, undated, Anchor 15545.
Document describing "Money Wheel" game, document refers to date of Jan. 1979, Anchor 15546.
Document showing "Money Wheel" game, undated, Anchor 15547.
Document describing "Silver Machine" game, document refers to date of Nov. 1981, Anchor 15548.
Document showing "Silver Machine" game, undated, Anchor 15549.
Document describing "Chase the Lady" game, document refers to date of Nov. 1988, Anchor 15551.
Document showing "Chase the Lady" game, undated, Anchor 15552.
Document describing "Seven Up" game, document refers to date of May 1987, Anchor 15553.
Document showing "Seven Up" game, undated, Anchor 15555.
Document describing "Lucky Dip" game, document refers to date of Feb. 1984, Anchor 15554.
Document that appears to show "Lucky Dip" game, undated, Anchor 15556.
Document stating "Oddballs—Various machines with 'discs' on them," undated, Anchor 15557.
Document showing "Risk Disks" game, undated, Anchor 15558.
Unidentified portion of article showing "Crazy Fruit" game, undated, Anchor 15559.
Unidentified portion of article, undated, Anchor 15560.
Portion of article from Coin Slot, which appears to be dated Mar. 1990, which appears to show "Multi–Money" game (in left hand picture), Anchor 15561.
Unidentified portion of article showing "Big Chance" game (bottom left), undated, Anchor 15562.
Portion of article from Coin Slot dated Jan. 18, 1985, Anchor 15564.
Document showing "Climax" game, undated, Anchor 15565.
Unidentified portion of article showing "Thesis Casino" game, undated, Anchor 15541.
Document showing "Money Trail" game, undated, Anchor 15566.
Document showing "Starstruck" and "Carnival" games, undated, Anchor 15568.
Documents showing "Lucky Casino" game, undated, Anchor 15570–15571.
Document showing "Spun Gold" game, undated, Anchor 15573.
Document showing "Spin Ball" game, undated, Anchor 15575.
Unidentified portion of article showing "Club Casino" game, undated, Anchor 15576.
Document showing "Double Dice" game, undated, Anchor 15577.
Portion of article from Coin Slot dated Jan. 26, 1980 showing "Wheel of Fortune" game (bottom left), Anchor 15578.
Document showing "Fun Fair" game, undated, Anchor 15579.
Document showing "Space Fruits" game, undated, Anchor 15580.
Document showing various games, handwritten date of Feb. 10, 1979, Anchor 15581.
Document showing "Fortune Wheel" game, undated, Anchor 15582.
Pages from Coin Slot, bearing a handwritten date that appears to be 1990, Anchor 15583–15584.
Unidentified portion of article, undated, Anchor 15585.
Page from Coin Slot that appears to be dated Nov. 9, 1984, Anchor 15586.
Document bearing a handwritten date of Aug. 30, 1980, Anchor 15587.
Document showing "Number 1" game, Anchor 15588.
Document showing "Cash Drop" game, Anchor 15589.
Document showing "Fortune Wheel" game, Anchor 15590.
Unidentified page showing various games including Money Wheel game, Anchor 15591.
Page from Coin Slot dated Jan. 16, 1982 showing various games including "Wheel of Fortune" and "Wheel 'n Deal" games, Anchor 15592.
Document showing various game, Anchor 15593.
Document showing "Risk Disks" game, undated, Anchor 15594.
Document showing "Silver Machine" game, undated, Anchor 15595.
Document showing "Fun Fair" game, undated, Anchor 15596.
43–page catalog showing various games of Barcrest Casino Technologies, page Anchor 15602 states "Price list per Jun. 1996," Anchor 15597–15641.
Document stating "Assorted Bonus Games—80s–90s," Anchor 15642.

Documents describing "Twist 'n Shout" game, undated, Anchor 15643–15644.
Documents describing "Ten/Twenty" game, undated, Anchor 15645–15646.
Document describing "Runna Round" game, undated, Anchor 15647.
Document describing "Casino Royale" game, undated, Anchor 15648.
Documents describing "Cabaret" game, undated, Anchor 15649–15650.
Documents describing "Double Diamond" game, undated, Anchor 15651–15652.
Documents describing "Eliminator" game, undated, Anchor 15653–15654.
Documents describing "Lucky Strike" game, undated, Anchor 15655–15656.
Documents describing "Super Series" game, undated, Anchor 15657–15658.
Document describing "Jim's Winning Streak" game, undated, Anchor 15659.
Document describing "Casino Royale" game, undated, Anchor 15660.
Document describing "Runna Round" game, undated, Anchor 15661.
Documents describing "Filthy Rich" game, undated, Anchor 15662–15663.
Documents describing "Snowball" game, undated, Anchor 15664–15665.
Document regarding Maygay, undated, Anchor 15666.
Document describing "Cash Trade" game, undated, Anchor 15667.
Documents describing "Go Pound Go" game, undated, Anchor 15668–15669.
Documents describing "Each Way Gambler" game, undated, Anchor 15670–15671.
Document showing "Reno Casino" game, undated, Anchor 15672.
Portion of unidentified article dated Nov./Dec. 1992, Anchor 15674.
Portion of unidentified article dated Jul./Aug. 1992, Anchor 15675.
Documents showing "New Orleans" game, undated, Anchor 15676–15677.
Document showing "Reel Roulette" game, undated, Anchor 15678.
Document showing "Zodiaco" game, undated, Anchor 15679.
4–page document entitled "The Complete AWP Package from JPM," undated, Anchor 15684–15687.
Documents showing "Filthy Rich" game, undated, Anchor 15688–15689.
Documents describing "Snowball" game, undated, Anchor 15690–15691.
Documents describing "Go Pound Go" game, undated, Anchor 15692–15693.
Documents describing "Ten/Twenty" game, undated, Anchor 15694–15695.
Documents describing "Win Pot" game, undated, Anchor 15696–15697.
Documents describing "Fortune Wheel" game, undated, Anchor 15698–15701.
Memorandum dated Nov. 26, 1998 from Peter Gerrard, Anchor 15702.
Documents showing "Monopoly" game, Anchor 15703–15704.
Document showing "Windsor Castle" game, handwritten date of 1968, Anchor 15705.
Document describing "Circus" game, undated, Anchor 15706.
Document stating "Photographs from Barcrests's Historical Files (Competitor's Machines)—Amusement With Prize (AWP)—1970s" Anchor 15707.
Document showing "Pik A Win" game, handwritten date of Sep. 14, 1977, Anchor 15708.
Document showing game, Anchor 15709.
Document showing unidentified game, Anchor 15710.
Document showing unidentified game, Anchor 15711.
Document showing unidentified game, Anchor 15712.
Document showing various games, undated, Anchor 15719.
Article entitled "Pub models out of the woods . . . ," undated, Anchor 15724.
Document describing "Ten/Twenty" game, undated, Anchor 15733.
Page from Coin Slot dated Feb. 28, 1985 regarding "Cashcade" game, Anchor 15734.
Document entitled "Coin Slot Archive Summary" and listing various dates and games, Anchor 15735.
Document showing "Top Strike" game, undated, Anchor 15736.
Document showing "Take the Money" game, undated, Anchor 15756.
Document showing "Break the Bank" game, undated, Anchor 15757.
Document showing "Wheel of Fortune" game, Anchor 15758.
15–page document describing "Wheel of Fortune" game, dated Dec. 1991, Anchor 15759–15773.
2–page handwritten document listing various games and dates, Anchor 15774–15775.
Document describing "Cashcade" game, document refers to date of Feb. 1985, Anchor 15790.
Article entitled "BWB Launches Fast–Playing Cashcade," undated, Anchor 15791.
Document listing various games and dates, Anchor 15793.
Unidentified document referring to "Jitterbug" and "Twist and Shout" games, handwritten date of Oct. 16, 1992, Acres 013956.
InterGame Magazine, Jun. 1995, cover page, initial page, p. 91 showing "Money Maker" game (IG24) and p. 101 showing "Roulette" game (IG59).
Geddes, Robert M., "Slot Machines on Parade," p. 128, published Oct. 1990.
Bueschel, Richard M., "Slots," p. 136, published in 1978.
Bueschel, Richard M., "Slots," p. 142, published in 1978.
Bueschel, Richard M., "An Illustrated Guide to the 100 Most Collectible Trade Simulators," p. 12 (1978), p. 29, p. 83.
Fey, Marshall, "Slot Machines," p. 126, (1983).
Fey, Marshall, "Slot Machines," p. 150, (1983).
Page 267 from "Chapter 11—1975–1984" describing game with "Double or Nothing Free–Spin Reel".
2–page document describing "Andy/Flo" game, handwritten date of 1995.
Document showing "Golden Wheels" game, undated (encircled "1" at top right).
Document showing "Circus" game, undated (encircled "2" at top right).

Document showing portion of game, undated (encircled "3" at top right).
Document showing "Carnival" game, handwritten date of 1986.
2–page document describing "Tic Tac Strike" game, 1986.
2–page document describing "Xs and Os" Tic Tac Toe game, 1983.
Document showing "Criss Cross Cash" game, undated.
2–page document describing "Andy's Full House" game, undated.
2–page documemt describing "Criss Cross" game, undated.
2–page document describing "Money Mint" game, undated, Acres 004663–004664.
Amusement Machine Guide, Jul./Aug. 1988, Anchor 15796–16037.
One–page abstract for federal Trademark Registration No. 2,226,443 for "Wheel of Gold" for slot machines and gaming machines showing date of first use in commerce as Dec. 29, 1995.
Verified Statement of Use Under 37 C.F.R. 2.88 dated Sep. 29, 1998 for "Wheel of Gold" trademark application, 3 pages.
John Edwards, article entitled "New Games Add More Bells, Whistles," Las Vegas Review–Journal and Las Vegas Sun, Oct. 22, 1995, Anchor 03590–03591.
Dave Palermo, article entitled "Randy Adams," Casino Executive Magazine, Sep. 1995, pp. 22–24, Anchor 03586–03589.
Weinert, Joe, "Tropicana Strikes Gold with New Slots," undated, Anchor 03620–03621.
Ehlers, David, "As Predicted, Wheel of Gold Looks Like a Hit," *Las Vegas Sun*, (Feb. 2, 1996) Anchor 03952.
Unidentified document showing "Full House" game, Anchor 15795.
17–page docket sheet dated Nov. 12, 2002 from Anchor Gaming v. Acres Gaming, Civil Action No. CV–S–99–0245.
Court document #1: "Complaint for Patent Infringement, Breach of Covenant Not to Compare and Breach of Implied and Express Warranties".
Court document #13: "Answer and Counterclaims of Acres Gaming, Inc.".
Court document #31: "Plaintiffs' Motion to Strike Defendant's Affirmative Defense of Inequitable Conduct".
Court document #32: "Plaintiff's Memorandum of Points and Authorities in Support of Their Motion Strike Defendant's Affirmative Defense of Inequitable Conduct".
Court document #33: "Anchor Gaming, Inc., Anchor Coin, Inc. and Spin for Cash Wide Area Progressive Joint Venture's Answer to Counterclaims of Acres Gaming, Inc.".
Court document #34: "Plaintiffs' Notice of Withdrawal of Their Motion to Strike Defendant's Affirmative Defense of Inequitable Conduct".
Court document #35: "Plaintiffs' Notice of Withdrawal of Their Motion to Strike Defendant's Affirmative Defense of Inequitable Conduct".
Court document #38: "First Amended Answer and Counterclaims of Acres Gaming, Inc.".
Court document #57: "Plaintiffs' Motion for Preliminary Injunction to Maintain the Status Quo".
Court document #57A: "Memorandum in Support of Plaintiff's Motion for Preliminary Injunction to Maintain the Status Quo".
Court document #62: "Acres' Opposition to Plaintiffs' Motion for a Preliminary Injunction".
Court document #86: Order dated Mar. 21, 2000.
Court document #112: "Stipulation and Order Regarding Damages Claims".
Court document #120: "Acres' Response to Anchor's Statement of Facts regarding Defendant's Affirmative Defenses".
Court document #124: "Acres Gaming's Opposition to Plaintiffs' Motion for Summary Judgment of Infringement".
Court document #125: "Acres' Response to Anchor's Statement of Undisputed Material Facts of Plaintiffs' Motion for Summary Judgment of Infringement".
Court document #140: "Acres Gaming's Motion for Leave to Submit Recent Federal Circuit Decision regarding Plaintiffs' Motion for Summary Judgment on Defendant's Counterclaims for Correction of Inventorship".
Court document #141: "Response to Acres Gaming's Motion for Leave to Submit Recent Federal Circuit Decision regarding Plaintiffs' Motion for Summary Judgment on Defendant's Counterclaims for Correction of Inventorship".
Court document #142: "Acres Gaming's Motion for Leave to Submit Recent Decision regarding Plaintiffs' Motion for Summary Judgment on Defendant's Counterclaims for Correction of Inventorship".
Court document #152: Order dated Feb. 27, 2001.
Court document #176: "Plaintiffs' Motion for Leave to Supplement the Record regarding Plaintiffs' Motion for Summary Judgment on Defendant's Counterclaims for Correction of Inventorship".
Court document #177: Minutes of Court of Jun. 21, 2002.
Court document #178: "Transcript of Proceedings of Plaintiff's Motion on Defendant's Affirmative Defense of Inequitable Conduct and Plaintiff's Motion for Summary Judgment for Correction of Inventorship".
Pages 49–72 and 169–184 of transcript of deposition of William Adams taken Jun. 10, 1999 and Adams Deposition Exhibits 14–17 (the exhibits are the best quality copies available).
Pages 41–44 of transcript of deposition of Michael Mitchell taken Oct. 22, 1999.
Pages 1 and 118–121 of transcript of deposition of Mark Hettinger taken Nov. 3, 1999.
Pages 1–5, 62–125 and 278–281 of transcript of deposition of Steve Hyman taken Nov. 12, 1999 and Hyman Deposition Exhibits 6 and 22 (the exhibits are the best quality copies available).
Complaint for Declaratory Judgment of Patent Noninfringement and Patent Invalidity dated Oct. 31, 2002 in Civil Action No. 02–1448.
Australian Opposition: 8–page document entitled "The Claims Defining The Invention Are As Follows" (Australian claims 1–41).
Australian Opposition: 7–page document entitled "Statement of Grounds and Particulars Relating To Each Ground".
Australian Opposition: "Statutory Declaration of Robert John Poynter" and Annexes RJB–1 through RJB–11.
Australian Opposition: "Statutory Declaration of Ante Milic" and Annexes AM–1 through AM–14.
Australian Opposition: "Statutory Declaration of Philip Clive Crouch" and Annex PCC–2.
"Complaint for Conversion, Fraudulent Concealment, Unjust Enrichment, Breach of Contract and Breach of Fiduciary Duty," Case No. 99–10125.
Court document #1: "Defendants' Notice of Removal of Civil Action to Federal Court Pursuant to 28 USC §§ 1331, 1338, 1441, et. seq.," Civil Action No. 99–698.

Court document #3: "Anchor Gaming's and Anchor Coin's Original Answer to Plaintiffs Original Complaint".
Court document #4: "Spin for Cash Progressive Wide Area Joint Venture's Original Answer to Plaintiff's Original Complaint".
Court document #5: "Defendants' Motion to Stay, Dismiss or Transfer Pursuant to 28 USC §1404(a)".
Court document #6: "Defendant's Brief in Support of Their Motion to Stay, Dismiss or Transfer".
Court document #11: "Plaintiff's Brief in Support of its Motion to Remand Case to State Court Pursuant to 28 U.S.C. § 1447(C)".
Court document #14: "Plaintiff's Opposition to Defendants' Motion to Stay, Dismiss or Transfer".
Court document #17: "Defendants' Brief in Opposition to Plaintiff's Motion to Remand Case to State Court".
Court document #18: "Plaintiff's Supplemental Brief in Support of its Motion to Remand Case to State Court".
Court document #19: "Defendants' Reply Brief in Support of Their Motion to Stay, Dismiss or Transfer".
Court document #21: "Defendants' Supplemental Response to Plaintiff's Supplemental Brief in Support of its Motion to Remand".
Court document #24: "Plaintiff's Reply Memorandum in Support of its Motion to Remand".
Court document #31: "Transcript of Proceedings" dated Aug. 24, 1999.
Court document #35: Order dated Sep. 29, 1999.
Court document #36: Order dated Sep. 29, 1999.
Notice of Removal dated Dec. 23, 2002 in Civil Action No. 02–81150 in the U.S. District Court for the Southern District of Florida.

Exhibit A: Report and Recommendation dated Apr. 17, 2002 in Civil Action No. 02–80237 in the U.S. District Court for the Southern District of Florida.

Exhibit B: Order Affirming Report and Recommendation dated Sep. 3, 2002 in Civil Action No. 02–80237 in the U.S. District Court for the Southern District of Florida.

Exhibit C: Order Affirming Report and Recommendation dated Apr. 19, 2002 in Civil Action No. 02–80237 in the U.S. District Court for the Southern District of Florida.

Exhibit D: Complaint of Plaintiff George May against International Game Technology, et al. filed Nov. 26, 2002 as Case No. 02–14149 in the Circuit Court of the Fifteenth Judicial District in and for Palm Beach County, Florida.

Exhibit E: Order Prohibiting Plaintiff George May From Filing Lawsuits Without Counsel or Without Court Approval dated Dec. 18, 1998 in Case No. 98–005841 in the Circuit Court of the Fifteenth Judicial District in and for Palm Beach County, Florida.

Motion to Dismiss Complaint and Incorporated Memorandum of Law dated Dec. 30, 2002 filed in Civil Action No. 02–80237 in the U.S. District Court for the Southern District of Florida.

Report and Recommendation dated Jan. 23, 2003 in Civil Action No. 02–81150 in the U.S. District Court for the Southern District of Florida.

Published Order dated Aug. 31, 2000 in George May v. Shell Oil Company, Civil Action No. 00–2266 in the U.S. District Court for the Southern District of Florida.

SLOT MACHINE WITH ADDITIONAL PAYOUT INDICATOR

This patent is a continuation of U.S. Ser. No. 09/444,986 filed in the Patent Office on Nov. 22, 1999, now abandoned, which is a continuation of U.S. Ser. No. 09/169,668 filed in the Patent Office on Oct. 9, 1998, now abandoned, which is a continuation of U.S. Ser. No. 08/622,430 filed in the Patent Office on Mar. 29, 1996, now U.S. Pat. No. 5,823,874, which is a continuation-in-part of U.S. Ser. No. 08/311,783 filed in the Patent Office on Sep. 23, 1994, now abandoned. All of the patent applications identified in this paragraph are incorporated by reference herein in their entirety.

RELATED PATENTS AND PATENT APPLICATIONS

A number of other patents and patent applications that claim priority from abandoned U.S. Ser. No. 08/311,783 filed Sep. 23, 1994 are set forth below.

U.S. Ser. No. 10/243,254 filed Sep. 13, 2002, now pending, is a continuation of U.S. Ser. No. 09/169,666 filed Oct. 9, 1998, now abandoned, which is a continuation of U.S. Ser. No. 08/907,764 filed Aug. 8, 1997, now U.S. Pat. No. 5,848,932, which is a continuation-in-part of U.S. Ser. No. 08/311,783 filed Sep. 23, 1994, now abandoned.

U.S. Ser. No. 09/157,994 filed Sep. 22, 1998, now U.S. Pat. No. 6,089,978, is a continuation-in-part of U.S. Ser. No. 08/907,764 filed Aug. 8, 1997, now U.S. Pat. No. 5,848,932, which is a continuation-in-part of U.S. Ser. No. 08/311,783 filed Sep. 23, 1994, now abandoned.

U.S. Ser. No. 09/157,995 filed Sep. 22, 1998, now pending, is a continuation-in-part of U.S. Ser. No. 08/907,764 filed Aug. 8, 1997, now U.S. Pat. No. 5,848,932, which is a continuation-in-part of U.S. Ser. No. 08/311,783 filed Sep. 23, 1994, now abandoned.

U.S. Ser. No. 10/243,253 filed Sep. 13, 2002, now pending, is a continuation of U.S. Ser. No. 10/033,594 filed Dec. 27, 2001, now abandoned, which is a continuation of U.S. Ser. No. 09/157,996 filed Sep. 22, 1998, now U.S. Pat. No. 6,334,814, which is a continuation-in-part of U.S. Ser. No. 08/907,764 filed Aug. 8, 1997, now U.S. Pat. No. 5,848,932, which is a continuation-in-part of U.S. Ser. No. 08/311,783 filed Sep. 23, 1994, now abandoned.

U.S. Ser. No. 10/157,607 filed May 29, 2002, now pending, is a continuation of, and U.S. Ser. No. 09/966,333 filed Sep. 27, 2001, now pending, is a continuation-in-part of, U.S. Ser. No. 09/676,612 filed Sep. 29, 2000, now abandoned, which is a continuation of U.S. Ser. No. 09/157,997 filed Sep. 22, 1998, now abandoned, which is a continuation-in-part of U.S. Ser. No. 08/907,764 filed Aug. 8, 1997, now U.S. Pat. No. 5,848,932, which is a continuation-in-part of U.S. Ser. No. 08/311,783 filed Sep. 23, 1994, now abandoned.

The present invention is directed to novel gaming devices and, more particularly, to gaming devices comprising at least one bonus indicator capable of indicating at least one of a plurality of bonuses.

BACKGROUND OF THE INVENTION

Games of chance have been enjoyed by people for thousands of years and have enjoyed widespread popularity in recent times. Many people enjoy playing a wide variety of games that they have not played before. Playing new games adds to the excitement of this recreational activity particularly when some form of "gaming" is involved. As used herein, the term "gaming" and "gaming devices" are used to indicate that some form of wagering is involved, and that players must make wagers of value, whether actual currency or some equivalent of value, e.g., token or credit.

One popular game of chance that has long been enjoyed by many players is the slot machine. Conventionally, a slot machine is configured for a player to input something of value, e.g., a standard denomination of currency or house token or other representation of currency or credit, and then to permit the player to activate the device which causes a plurality of reels to spin and ultimately stop to display a random combination of some form of indicia, for example, numbers or symbols. If this display contains one of a preselected plurality of winning combinations, the machine releases money into a payout chute or onto a credit meter for the player. For example, if a player initially wagered two coins of a national currency and that player won a high payout, that player may receive fifty coins of the same denomination in return.

Since it is desirable to offer players games which they have not played before, it would be desirable to provide a player with new games and additional opportunities to receive winning payouts.

Those familiar with games involving winning payouts, such as the popular television game show entitled "WHEEL OF FORTUNE" will realize that as players and observers watch a large wheel spin and gradually come to rest, the players experience a heightened feeling of anticipation and excitement as the wheel is slowing down to indicate a possible prize.

It would therefore also be desirable to provide a payout indicator which is discernible by a player and/or other observers.

SUMMARY OF THE INVENTION

Various embodiments of the present invention comprise gaming devices having a first gaming unit, e.g., rotatable reels and at least one discernible indicia of a mechanical bonus payout indicator. According to the most preferred embodiments, the bonus payout indicator is clearly visible to a player and is operable when primary reels of a slot machine stop on certain predetermined indicia. According to one preferred embodiment of the present invention, a bonus indicator is in the form of a rotatable bonus wheel which can be caused to spin automatically or in response to some action by a player, e.g., the player pushing a button, when the primary reels indicate one of a predetermined plurality of indicia. When the wheel stops, a pointer indicates the bonus payout to be awarded to the player.

Another preferred embodiment of the present invention further comprises a discernible multiplier which provides the ability to change either the payout from the primary gaming unit or the bonus indicator, or both. As described in more detail below, it is within the scope of the present invention to provide a payout from the primary gaming unit, a payout indicated by the bonus indicator only, a payout from the primary gaming unit or the bonus indicator as changed by the multiplier, or a separate, plurality of payouts from the primary gaming unit and the bonus indicator either with or without modification by a multiplier.

According to one preferred embodiment of the present invention, the mechanical bonus payout indicator is electromechanically operated and is linked to a random number generator which determines where the bonus indicator actually stops.

According to another preferred embodiment of the present invention, when the primary reels stop on one of a predetermined plurality of winning indicia sets, a bonus actuator is placed in an active state. According to this embodiment, a person, such as the player, must actuate the actuator in order to operate the bonus indicator.

According to another embodiment of the present invention, the bonus actuator requires operator intervention so that a player must involve a casino attendant who can activate the bonus indicator.

According to another preferred embodiment of the present invention, the bonus indicator is connected to a drive mechanism which gradually reduces the rate of spin of the bonus wheel before the bonus wheel stops.

Still other embodiments of the present invention comprise gaming devices having electronic means for displaying indicia of rotatable reels such as a video screen and/or means for displaying indicia of a bonus payout indicator, such as a video screen. The present invention also comprises methods for playing a game of chance. One preferred method comprises the steps of a first, standard gaming unit for displaying a randomly selected combination of indicia, said displayed indicia selected from the group consisting of slot reels, indicia of reels, indicia of playing cards, and combinations thereof; said first, standard gaming unit comprising means for generating at least one signal corresponding to at least one select display of indicia; means for providing at least one discernible indicia of a mechanical bonus indicator, said bonus indicator indicia providing means indicating at least one of a plurality of possible bonuses, wherein said bonus indicator indicia providing means is operatively connected to said first, standard gaming unit and actuatable in response to said signal.

Further embodiments of the present invention comprises a method of conducting a game of chance comprising the steps of providing a player with an opportunity to place a wager; displaying a randomly selected combination of indicia, said displayed indicia selected from the group consisting of reels, indicia of reels, indicia of playing cards, and combination thereof; generating at least one signal corresponding to at least one select display of said indicia; providing at least one discernible indicia of a mechanical bonus indicator, said bonus indicator indicia indicating at least one of a plurality of possible bonuses, wherein said bonus indicator indicia is in the form of a wheel or reel and is actuatable in response to said signal.

DETAILED DESCRIPTION

Figure 1:
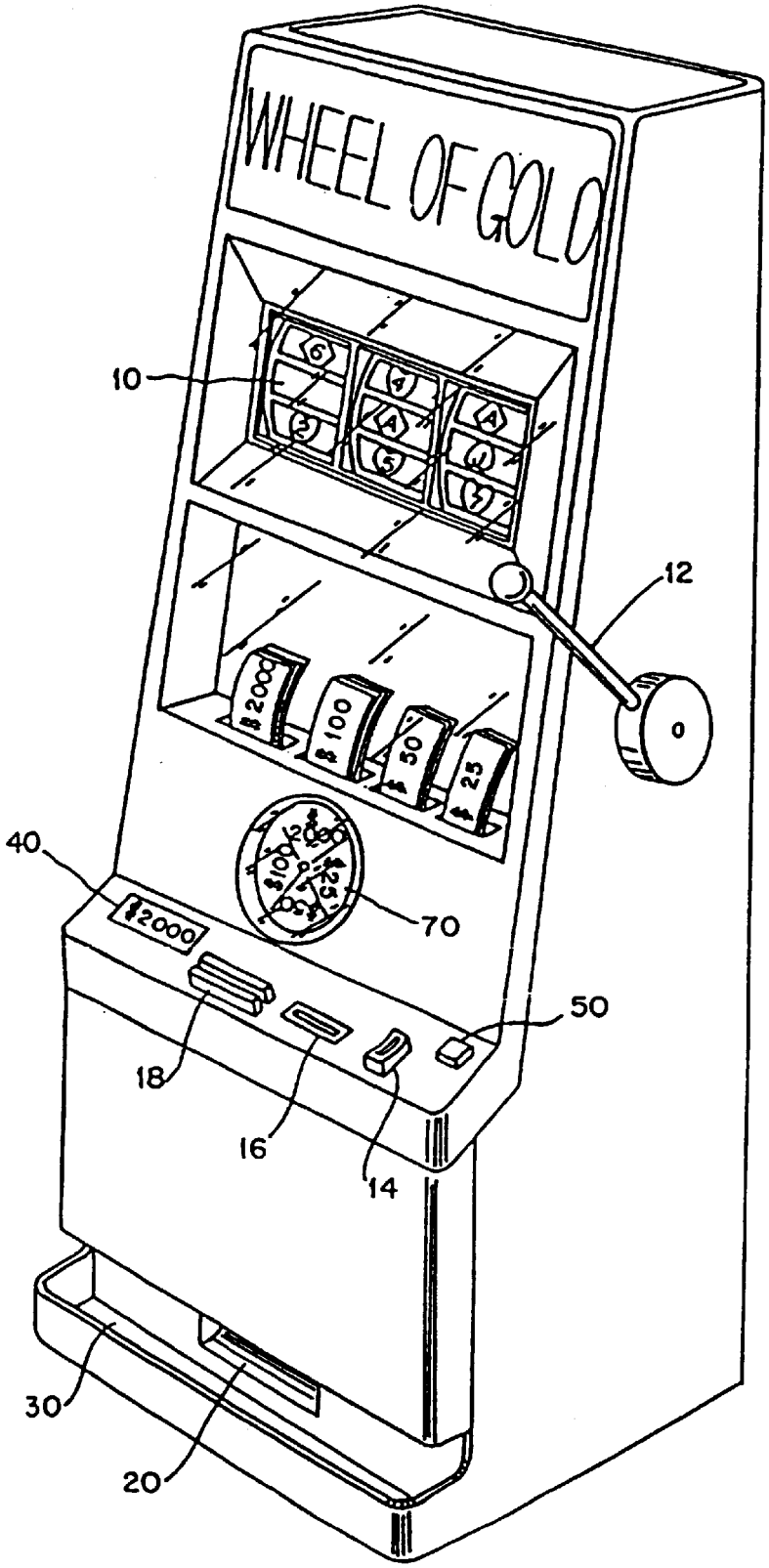
FIG. 1 is a perspective view one of a gaming device of one embodiment of the present invention.

The various embodiments of the present invention are designed to provide added excitement to a gaming device in order to increase the enjoyment to players and to serve as an added attraction to potential players. One preferred embodiment of the present invention, illustrated in FIG. 1, comprises a primary gaming unit which comprises three rotatable reels 10, each of which comprise a plurality of indicia on the periphery thereof. The illustrated gaming device comprises a mechanical lever 12, coin slot 14, currency validator 16 and a credit card validator 18. In a manner which will be recognized by those skilled in the art, each reel 10 is designed to rotate and then stop in order to visually display at least one, and preferably a number of indicia. If the collection of indicia displayed by the three reels is one of a predetermined plurality of winning indicia sets, then the player can typically be provided with a winning payout either through coin chute 20 which deposits winnings into a coin trough 30 or by increasing the player's credits in a credit window 40.

According to one aspect of the present invention, when the reels 10 display a particular indicia set then the player is provided with an opportunity for a bonus. According to this illustrated embodiment of the present invention, a bonus actuator button 50 is placed in an operative state when reels 10 display a bonus indicia set. A player must then depress bonus actuator 50 in order to start bonus indicator 70 spinning. In the illustrated embodiment, bonus indicator 70 is in the form of a rotatable wheel. The wheel may be a carnival-type wheel comprising pegs and a clapper or could take one or more other forms, such as a fanciful wheel typically used in a roulette game as shown in the embodiment of FIG. 2. The facing surface of bonus indicator 70 of FIG. 1 comprises four distinct areas bearing indicia of the bonus payout to the player. In the illustrated embodiment, the bonus indicator has areas indicating bonuses of $25.00, $50.00, $100.00, and $2,000.00. When bonus indicator 70 stops, an indicator (not shown) will indicate the area on the bonus wheel corresponding to the amounts of the bonus to be provided to the player.

In a manner which will be appreciated by those skilled in the art, bonus indicator 70 can be operatively linked to a "payout" mechanism which provides a bonus payout to a player through currency chute 20 or by increasing the amount of winnings shown in credit window 40. As stated above, the payout of the bonus indicator can be in addition to a standard payout by the primary gaming unit or can be in place of the payout normally associated with the primary gaming unit.

Those familiar with gaming and game shows, will appreciate that players and observers typically experience a heightened level of anticipation and excitement as they observe one or more moving objects approaching a winning position. It is therefore most preferred for the bonus indicator of the present invention to be readily discernible, e.g., clearly visible and/or audible to the player.

According to another preferred embodiment of the present invention, a bonus indicator is connected to a electromechanical control unit, for example a motor, which gradually decreases the rate of movement of the bonus indicator before the bonus indicator stops. According to this embodiment of the present invention, players can be provided with a realistic sense of a totally mechanical indicator. Those skilled in the art will appreciate that such a control unit can also readily be connected to a random generator which will randomly select the winning payout according to a predetermined frequency of occurrence for each individual bonus payout, and then cause the bonus indicator to stop at the desired area.

According to another embodiment of the present invention, when reels 10 display an indicia set which will provide a bonus, the bonus indicator becomes activatable but requires intervention by a house attendant, such as a casino attendant, in order to actuate the bonus indicator. According to this embodiment of the present invention, the casino is provided with greater control over the actuation of the bonus indicator and, if desired, can accompany the actuation of the bonus indicator with great fanfare. It will be appreciated that the amounts of the bonus indicated in the figures are merely for purposes of illustration and, if desired, one of the amounts on the bonus indicator can have a significantly greater value. For example, one of the areas on the bonus indicator may correspond to a new automobile, a luxury vacation or a very large sum of money.

Figure 2:
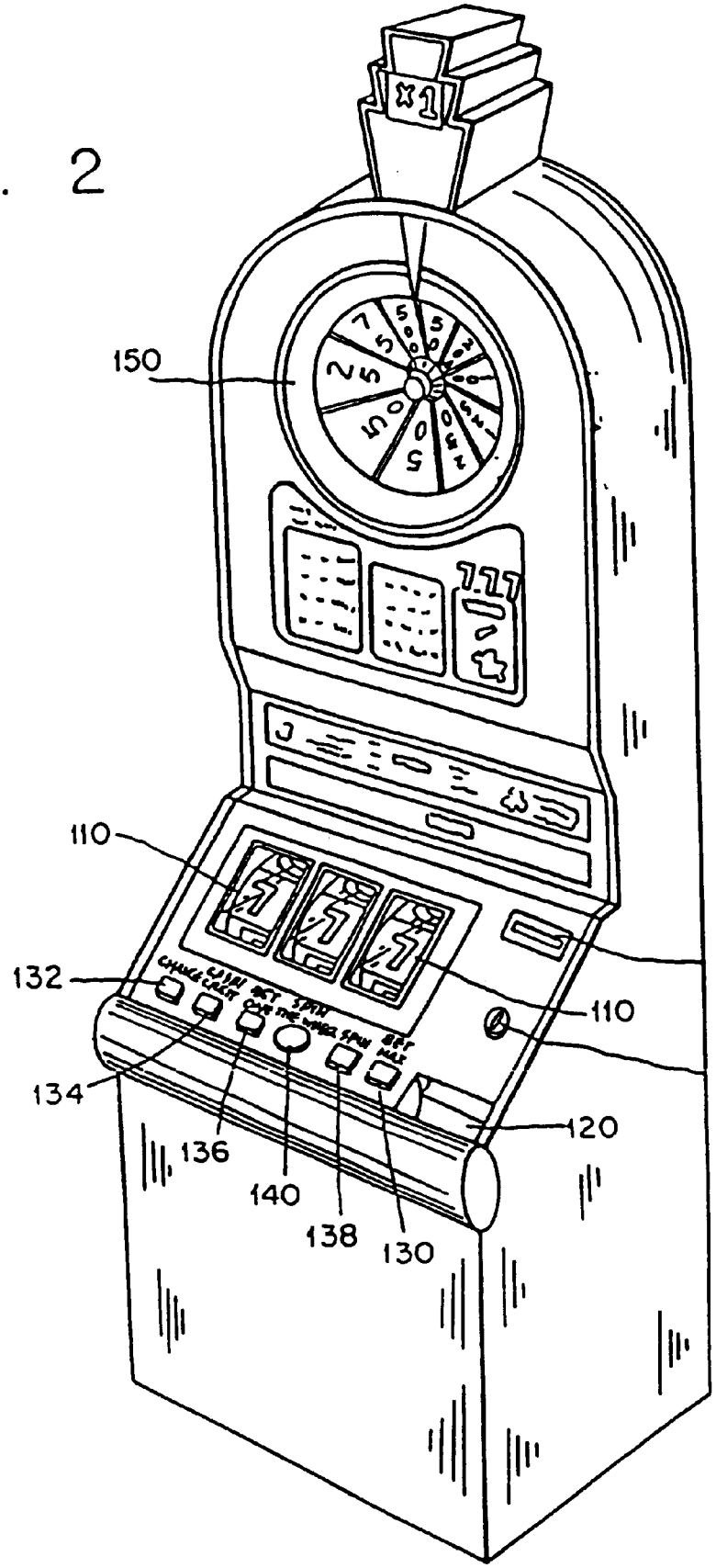
FIG. 2 is another embodiment of a gaming device of the present invention.

While the illustrated embodiment of the present invention in FIG. 1 is generally in the form of a rotatable wheel, other visible, mechanical indicia can be provided, whether controlled totally mechanically, electro-mechanically, or electronically without departing from the scope of the present invention.

As shown in FIG. 1, in order to provide additional levels of excitement, indicia of the possible bonuses are preferably visibly displayed within the slot machine. For example, in the illustrated embodiment, a shelf is preferably displayed comprising piles of currency equal to the amounts on the bonus indicator. While actual cash is preferred, the slot machine may also be provided with fake currency or simply indicia of actual currency or the other bonus prizes.

A preferred embodiment of the present invention is illustrated in FIG. 2 wherein a gaming device 100 comprises a primary gaming unit in the form a standard three-reel slot machine which displays reels 110. Suitable controls and currency mechanisms including a coin slot 114, bill validator 118, payout shoot 120 are provided. Furthermore, suitable player controls including CHANGE button 132, CASH/CREDIT button 134, BET ONE button 136, SPIN button 138 and BET MAX button 130 are also provided.

In addition to these standard controls the control panel of this preferred illustrated embodiment of the present invention comprises a SPIN THE WHEEL button 140 which becomes actuatable when the primary gaming unit, as indicated by reels 110, has randomly selected one of a plurality of predetermined indicia sets. While the primary gaming unit shown in the lower portion of the cabinet of gaming device 100 will typically have the ability to provide a plurality of winning payouts, the SPIN THE WHEEL button 140 can become actuatable when the stopped reels 110 indicate some subset of the primary unit's winning indicia, when any one of the winning reel indicia are displayed, or further in response to one or more other predetermined indicia, or a combination thereof.

When the SPIN THE WHEEL button 140 is actuated by a player, bonus wheel 150 is caused to rotate and randomly select and display one of a plurality of different areas. According to the preferred illustrated embodiment, all of the bonus areas indicate an increased winning value for the player. However, it is within the scope of the present invention to provide non-monetary prizes or losing spaces wherein no additional prize is provided and/or wherein the prize normally associated with the indicia shown on the primary gaming unit reels 110 is reduced. In the illustrated embodiment, a pointer 160 advantageously indicates the result of the bonus indicator 150.

In addition to the bonus wheel 150, this preferred illustrated embodiment of the present invention also comprises a bonus multiplier 170. The multiplier 170 preferably randomly selects a value by which the bonus indicated by bonus wheel 150 is multiplied. For example, the bonus indicator 170 can have an LED screen which cycles through multipliers of "times one", "times two" and "times three" which will indicate that the bonus is as indicated, doubled, or tripled, respectively. The multiplier 170 can be programmed to select a multiplier either totally randomly or according to some other predetermined frequency of occurrence wherein certain multipliers will occur more frequently than other multipliers. While this illustrated embodiment comprises whole number multipliers, it is also within the scope of the present invention to utilize values other than whole numbers or to include multipliers which will result in a decrease in the value shown by the bonus indicator 150. For example, a multiplier sequence could include a "times zero" value. When bonus wheel indicator 150 is not in use, the multiplier LED window can be set to an attract mode wherein a message is displayed to players or potential players. For example, the LED display could show a message, either in complete form or can be set to sequentially display either words or individual letters, such as "SPIN-THE-WHEEL".

Figure 3:
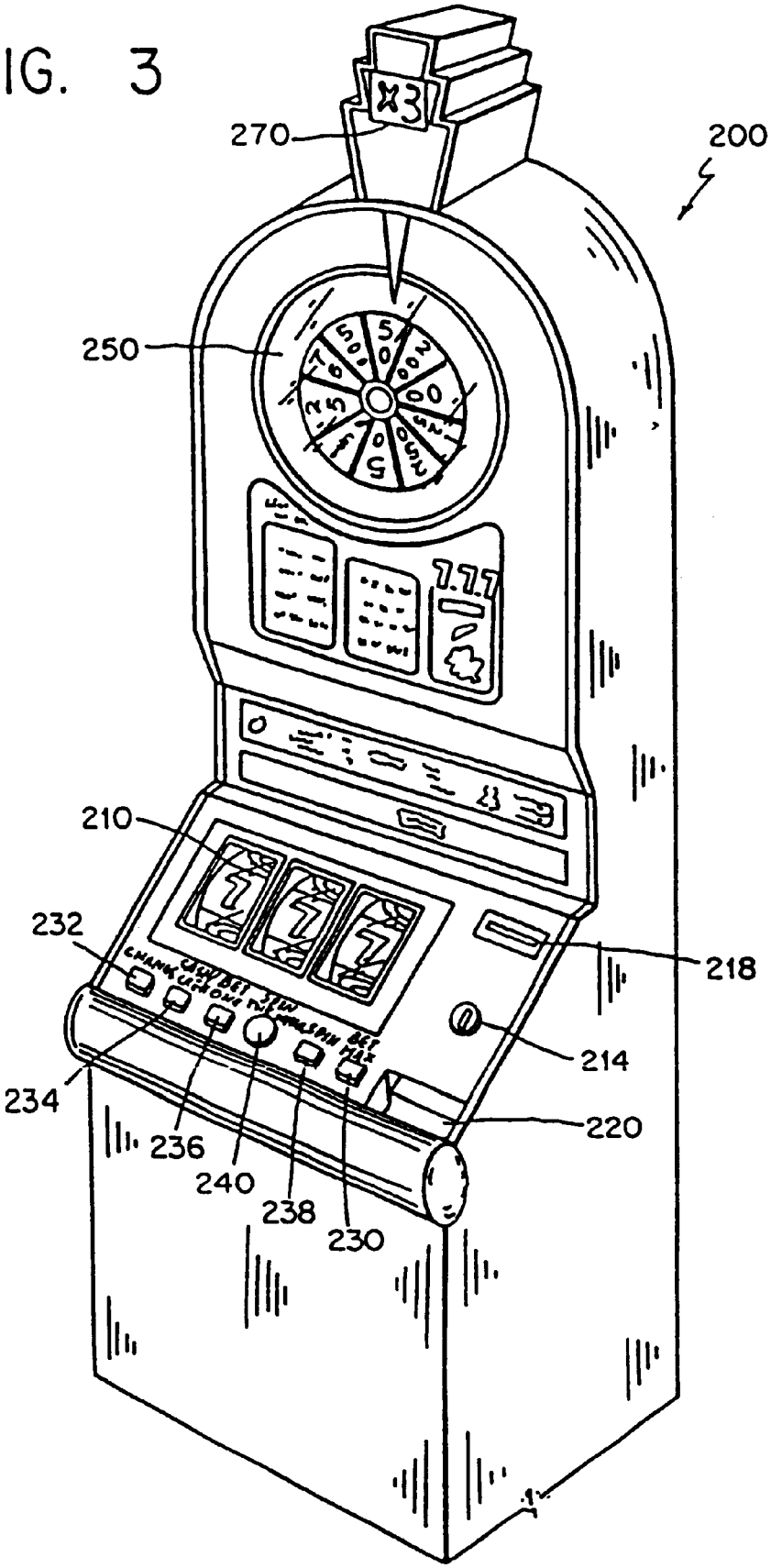
FIG. 3 illustrates an alternative embodiment of the present invention.

FIG. 3 illustrates a less preferred embodiment of the present invention wherein a gaming device 200 comprising similar controls as the controls illustrated in the embodiment of FIG. 3. In this illustrated embodiment, and wherein a bonus indicator 250 is in the form of an electronically generated image, such as a video screen or an LED display and provides discernible indicia, e.g., a visual video display, of a bonus wheel. For example, the video display can show a wheel of the type used in a roulette game such as the wheel 150 illustrated in FIG. 2.

The slot machine shown in FIG. 3 comprises a video display 210, such as a video screen, which displays three reels 110, each of which comprise a plurality of indicia. In addition, this slot machine comprises a video display 250, such as a second video screen, for displaying a bonus payout indicator. While separate screens are preferred, both the reels and the bonus payout indicator could be displayed on the same video screen. According to this embodiment of the present invention, the bonus payout indicator displays indicia of a wheel or a reel.

In a manner known in the art, the gaming device comprises a coin slot 214, a currency validator 218, and a coin chute 220. After placing a wager, a player determines the amount of his wager by either pressing the BET ONE button 236 or the BET MAX button 230. After the player has selected the amount of his wager, he depresses the SPIN button 238 which "spins" the reels shown in video display window 210.

Each indicia of a displayed reel 210 is designed to indicate rotation and then stop in order to visually display at least one, and preferably a number of indicia. When reels 210 display a particular indicia set or one of a predetermined plurality of indicia sets, then the additional payout mode is activated and video display 250 displaying payout indicator is placed in an operable state. In this illustrated embodiment, the displayed payout indicator 250 displays an indicia of a rotating wheel comprising a plurality of distinct areas bearing indicia of payouts to the player. Payout indicator 250, is caused to selectively indicate one of the plurality of indicia, either automatically, upon intervention of a casino or house attendant, or upon a player depressing SPIN THE WHEEL button 240 in order to start indicator 250 spinning. It will be appreciated that the amounts of the payout indicated in FIG. 2 are merely for purposes of illustration and, if desired, one of the amounts on the bonus indicator can have a greater value, e.g., a new automobile, a luxury vacation or large sum of money which may be collected subsequently, or lesser values, e.g., no payout.

The displayed reels 210 and displayed bonus indicator 250 can be operably controlled by suitable controls to slow down as they come to a complete stop, displaying a selected reel indicia and a bonus indicia, respectively.

The embodiment of the present invention illustrated in FIG. 2 is considered most preferable since it is believed that players prefer to see actual slot reels and an actual bonus wheel spinning in a gaming device. Other, less preferred embodiments are also possible while providing some of the advantages of the present invention. Specifically, it is feasible to replace the spinning reels with other forms of standard gaming units, for example, a visible indicia of reels or indicia of playing cards, shown for example on a video screen. It is also possible to replace the wheel with some other discernible indicia of a mechanical bonus indicator which is operatively connected to the first standard gaming unit and which either automatically commences or is actuatable in response to the result provided by the standard gaming unit. According to the present invention, both of the standard gaming unit and bonus indicator are controlled to provide random results.

From the foregoing description, it will be appreciated that embodiments of the present invention, which are specifically directed to gaming and gaming devices, comprise three different indicators. The most preferred embodiments comprise a primary (standard) gaming unit, an additional payout indicator, preferably in the form of a wheel, and a payout multiplier. While the illustrated payout multiplier of the illustrated embodiments is in the form of an electronically selected value, it is also within the scope of the present invention to have a multiplier which involves some skill on the part of a player. For example, according to an additional preferred embodiment of the present invention, a player will shoot actual projectiles, such as coins, at one or more targets in an effort to increase the value of the multiplier. In any of the embodiments of the present invention utilizing a multiplier, the multiplier can affect the value of a payout from the standard gaming unit, the additional payout indicator, or both the standard gaming unit and the payout indicator.

As stated above, the present invention also includes methods of conducting a wagering game of chance comprising the steps of providing a player with an opportunity to place a wager; displaying a randomly selected combination of indicia, said displayed indicia selected from the group consisting of reels, indicia of reels, indicia of playing cards, and combination thereof; generating at least one signal corresponding to at least one select display of said indicia; providing at least one discernible indicia of a mechanical bonus indicator, said bonus indicator indicia indicating at least one of a plurality of possible bonuses, wherein said bonus indicator indicia is in the form of a wheel or reel and is actuatable in response to said signal. A further preferred method comprises the step of displaying at least one value by which a payout may be multiplied.

What is claimed is:

1. A slot machine, comprising:

a housing having a front portion and two side portions;

a value-input device;

a first slot machine reel having a plurality of first reel symbols disposed thereon;

a second slot machine reel having a plurality of second reel symbols disposed thereon;

a third slot machine reel having a plurality of third reel symbols disposed thereon;

one of said first, second and third slot machine reels being rotatable about an axis that passes through said side portions of said housing;

a movable mechanical bonus indicator comprising a rotatable wheel bonus indicator having a face, said rotatable wheel bonus indicator being rotatable about an axis that passes through a central point of said rotatable wheel bonus indicator, said axis about which said rotatable wheel bonus indicator is rotatable not being parallel to said axis about which said one slot machine reel is rotatable;

a plurality of circumferentially arranged bonus areas comprising a first bonus area, a second bonus area, and a third bonus area, said bonus areas being circumferentially disposed on said face of said rotatable wheel bonus indicator around said central point;

a plurality of bonus symbols disposed on said rotatable wheel bonus indicator in said bonus areas, said bonus symbols including a first bonus symbol comprising a numeral disposed in said first bonus area, a second bonus symbol comprising a numeral disposed in said second bonus area, and a third bonus symbol comprising a numeral disposed in said third bonus area, each of said bonus symbols indicating a respective one of a plurality of bonus amounts, all bonus symbols disposed on said rotatable wheel bonus indicator being simultaneously visible to a player;

said rotatable wheel bonus indicator being rotated after display of at least one of said first, second and third reel symbols;

a random generator that selects one of said bonus amounts in order to cause said rotatable wheel bonus indicator to stop at a stop position at which said rotatable wheel bonus indicator visually indicates to a player said one bonus amount selected by said random generator; and a control unit operatively coupled to said random generator, said control unit comprising a motor and being operatively coupled to control movement of said rotatable wheel bonus indicator, said control unit causing said rotatable wheel bonus indicator to stop moving at said stop position.

2. A slot machine as defined in claim 1 additionally comprising a fourth bonus area circumferentially disposed about said central point and a fourth bonus symbol disposed in said fourth bonus area.

3. A slot machine as defined in claim 1 wherein one of said first, second and third bonus symbols comprises a multi-digit numeral.

4. A slot machine as defined in claim 1 wherein said first, second and third bonus areas are circularly arranged about said central point.

5. A slot machine as defined in claim 1 additionally comprising a bonus actuator that is activatable by a player, said bonus actuator causing said rotatable wheel bonus indicator to start rotating in response to being activated by the player.

6. A slot machine, comprising:

a housing having a front portion and two side portions;

a value-input device;

a plurality of first reel symbols;

a plurality of second reel symbols;

a plurality of third reel symbols;

a movable mechanical bonus indicator comprising a rotatable wheel bonus indicator having a face, said rotatable wheel bonus indicator being rotatable about an axis that passes through a central point of said rotatable wheel bonus indicator, said axis about which said rotatable wheel bonus indicator is rotatable not passing through either of said two side portions of said housing;

a plurality of circumferentially arranged bonus areas comprising a first bonus area, a second bonus area, and a third bonus area, said bonus areas being circumferentially disposed on said face of said rotatable wheel bonus indicator around said central point;

a plurality of bonus symbols disposed on said rotatable wheel bonus indicator in said bonus areas, said bonus symbols including a first bonus symbol comprising a numeral disposed in said first bonus area, a second bonus symbol comprising a numeral disposed in said second bonus area, and a third bonus symbol comprising a numeral disposed in said third bonus area, each of said bonus symbols indicating a respective one of a plurality of bonus amounts;

said rotatable wheel bonus indicator being rotated after display of at least one of said first, second and third reel symbols;

a random generator that selects one of said bonus amounts in order to cause said rotatable wheel bonus indicator to stop at a stop position at which said rotatable wheel bonus indicator visually indicates to a player said one bonus amount selected by said random generator; and a control unit operatively coupled to said random generator, said control unit comprising a motor and being operatively coupled to control movement of said rotatable wheel bonus indicator, said control unit causing said rotatable wheel bonus indicator to stop moving at said stop position.

7. A slot machine as defined in claim 6 additionally comprising a fourth bonus area circumferentially disposed about said central point and a fourth bonus symbol disposed in said fourth bonus area.

8. A slot machine as defined in claim 7 wherein all bonus symbols disposed on said rotatable wheel bonus indicator are simultaneously visible to a player during movement of said rotatable wheel bonus indicator.

9. A slot machine as defined in claim 6 wherein one of said first, second and third bonus symbols comprises a multi-digit numeral.

10. A slot machine as defined in claim 6 wherein said first, second and third bonus areas are circularly arranged about said central point.

11. A slot machine as defined in claim 6 additionally comprising a bonus actuator that is activatable by a player, said bonus actuator causing said rotatable wheel bonus indicator to start rotating in response to being activated by the player.

12. A slot machine as defined in claim 6 additionally comprising:

a first slot machine reel that is rotatable;

a second slot machine reel that is rotatable; and a third slot machine reel that is rotatable, wherein said plurality of first reel symbols are disposed on a circumferential surface of said first slot machine reel, wherein said plurality of second reel symbols are disposed on a circumferential surface of said second slot machine reel, and wherein said plurality of third reel symbols are disposed on a circumferential surface of said third slot machine reel.

13. A slot machine, comprising:

a housing having a front portion and two side portions;

a value-input device;

a plurality of first reel symbols;

a plurality of second reel symbols;

a plurality of third reel symbols;

a movable mechanical member that is movably supported for movement about an axis, said axis about which said movable mechanical member is movably supported not passing through either of said two side portions of said housing;

a plurality of circumferentially arranged bonus areas comprising a first bonus area, a second bonus area, and a third bonus area, said bonus areas being circumferentially arranged about said axis about which said movable mechanical member is movably supported;

a plurality of bonus symbols disposed in said bonus areas, said bonus symbols including a first bonus symbol comprising a numeral disposed in said first bonus area, a second bonus symbol comprising a numeral disposed in said second bonus area, and a third bonus symbol comprising a numeral disposed in said third bonus area, each of said bonus symbols indicating a respective one of a plurality of bonus amounts;

said movable mechanical member being moved after display of at least one of said first, second and third reel symbols;

a random generator that selects one of said bonus amounts in order to cause said movable mechanical member to stop at a stop position at which said movable mechanical member visually indicates to a player said one bonus amount selected by said random generator; and a control unit operatively coupled to said random generator, said control unit comprising a motor and being operatively coupled to control movement of said movable mechanical member, said control unit causing said movable mechanical member to stop moving at said stop position.

14. A slot machine as defined in claim 13 additionally comprising a fourth bonus area circumferentially disposed about said central point and a fourth bonus symbol disposed in said fourth bonus area, wherein said four bonus symbols differ from each other.

15. A slot machine as defined in claim 14 wherein all bonus symbols disposed in said bonus areas are simultaneously visible to a player during movement of said movable mechanical member.

16. A slot machine as defined in claim 13 wherein one of said first, second and third bonus symbols comprises a multi-digit numeral.

17. A slot machine as defined in claim 13 wherein said first, second and third bonus areas are circularly arranged about said central point.

18. A slot machine as defined in claim 14 additionally comprising a bonus actuator that is activatable by a player, said bonus actuator causing said movable mechanical member to start moving in response to being activated by the player.

19. A slot machine as defined in claim 13 additionally comprising:

a first slot machine reel that is rotatable;

a second slot machine reel that is rotatable; and a third slot machine reel that is rotatable, wherein said plurality of first reel symbols are disposed on a circumferential surface of said first slot machine reel, wherein said plurality of second reel symbols are disposed on a circumferential surface of said second slot machine reel, and wherein said plurality of third reel symbols are disposed on a circumferential surface of said third slot machine reel.

* * * * *

UNITED STATES PATENT AND TRADEMARK OFFICE

CERTIFICATE OF CORRECTION

PATENT NO. : 6,605,000 B2
DATED : August 12, 2003
INVENTOR(S) : William R. Adams It is certified that error appears in the above-identified patent and that said Letters Patent is hereby corrected as shown below:

Title page,
Item [56], References Cited, OTHER PUBLICATIONS, "Bueschel, Richard M.," reference, please delete "p. 12" after "Collectible Trade Simulators," and insert -- p. 21 -- therefor.
"17-page docket sheet dated Nov. 12, 2002" reference, please delete "Compare" after "Breach of Covenant Not to" and insert -- Compete -- therefor.

Column 5,
Line 23, please delete "in the form a standard" and insert -- in the form of a standard -- therefor.

Column 7,
Lines 13-14, please delete "both of the standard gaming unit" and insert -- both the standard gaming unit -- therefor.

Signed and Sealed this

Twentieth Day of January, 2004

JON W. DUDAS
*Acting Director of the United States Patent and Trademark Office*